US006140413A

United States Patent [19]

Castles et al.

[11] Patent Number: 6,140,413

[45] Date of Patent: Oct. 31, 2000

[54] SILICONE SOFTENER VISCOSITY REDUCER

[75] Inventors: Lindsay N. Castles, Charlotte; Steve C. James, Gastonia, both of N.C.; John Stewart, York, S.C.

[73] Assignee: Henkel Corporation, Gulph Mills, Pa.

[21] Appl. No.: 09/280,765

[22] Filed: Mar. 29, 1999

[51] Int. Cl.[7] ..... C08L 83/08; D06M 15/643

[52] U.S. Cl. ..... 524/838; 8/115.64; 8/115.65; 8/DIG. 1; 252/8.63; 252/FOR 100; 252/FOR 103; 427/387; 427/389.9; 528/27; 528/29; 528/38

[58] Field of Search ..... 524/838; 528/27, 528/29, 38; 252/8.63, FOR 100, FOR 103; 8/DIG. 1, 115.64, 115.65; 427/387, 389.9

[56] References Cited

U.S. PATENT DOCUMENTS

| | | | |
|---|---|---|---|
| 4,865,768 | 9/1989 | Veitenhansl et al. | 260/403 |
| 4,975,091 | 12/1990 | Becker et al. | 8/115.66 |
| 5,075,403 | 12/1991 | Kirk | 528/15 |
| 5,147,578 | 9/1992 | Kirk | 252/358 |
| 5,238,731 | 8/1993 | Blanch et al. | 428/266 |
| 5,277,968 | 1/1994 | Canivenc | 428/245 |
| 5,336,715 | 8/1994 | Sejpka et al. | 524/765 |
| 5,540,952 | 7/1996 | Canivenc et al. | 427/387 |
| 5,688,889 | 11/1997 | Canivenc et al. | 528/40 |

*Primary Examiner*—Margaret G. Moore
*Assistant Examiner*—Jeffrey B. Robertson
*Attorney, Agent, or Firm*—John E. Drach; Steven J. Trzaska

[57] ABSTRACT

A process for making a textile softening composition having a viscosity of up to about 100 cps, involving the steps of: (a) forming a primary mixture by combining, with agitation: (i) acetic acid; (ii) an alkoxylated alcohol; and (iii) water; and (b) adding to the primary mixture, with agitation, the following components: (iv) a first portion of a polyorganosiloxane having at least one pendant sterically hindered 2° amine functionality; (v) a first portion of a base component; (vi) a second portion of the polyorganosiloxane; and (vii) a second portion of the base component.

10 Claims, No Drawings

SILICONE SOFTENER VISCOSITY REDUCER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Re-texturing is part of the textile finishing process and is intended to impart to flock, slubbing, fabric, knitted goods or non-woven materials in particular such properties as feel, smoothness, anti-static properties and body as a result of which their appearance, marketability, effectiveness in use and processing qualities are improved.

The textile aids used for re-texturing can, for example, be applied onto textile fiber materials in a total immersion bath (exhaustion process). In the total immersion treatment, the textiles are wetted for a long period at a high wash-liquor ratio and then de-watered by squeezing, extraction or centrifuging. Compared to other types of treatment processes such as foularding, padding, doctoring or spraying, the total-immersion treatment has the advantage that the treatment times and temperatures can be chosen and varied at will.

Conventional smoothing/softening aids include condensation products prepared from a hydroxyalkyl polyamine and a fatty acid glyceride, along with amino-silicone compounds, which are used in the form of aqueous dispersions. It is also known that the higher the amine content in a smoothing/softening aid, the softer the finished product will feel. However, the presence of a high degree of amines in compounds such as these makes them susceptible to oxidative degradation, thus causing textiles treated therewith to become yellowed during application.

One solution to the oxidative degradation and concomitant yellowing encountered with amino-silicone softening aids has been to employ secondarily hindered amines-silicone compounds (hindered amine siloxanes). These types of compounds have a hindered amine light stabilizing molecule grafted onto a silicone backbone. Due to the presence of a highly hindered, secondary-amine, the possibility of oxidation of the amine is greatly reduced so that high energy levels would be required in order to de-stabilize the chemical structure and cause undesirable yellowing. Secondarily hindered amines of this type also provide free radical scavenging properties which further prevent oxidation and subsequent yellowing.

However, one problem associated with the use of these types of secondarily hindered amine siloxanes relates to their tendency to exist as highly viscous compositions which require the use of sophisticated and involved mixing apparatuses in order to formulate them into pumpable, low-viscosity liquids which can be easily introduced into an aqueous bath on demand.

BRIEF SUMMARY OF THE INVENTION

The present invention is directed to a process for making a textile softening composition having a viscosity of up to 100 cps, involving the steps of:

(a) forming a primary mixture by combining, with agitation:

(i) from about 0.15 to about 1% by weight of acetic acid;

(ii) from about 5 to about 15% by weight of an alkoxylated alcohol; and (iii) from about 60 to about 80% by weight of water; and (b) adding to the primary mixture, with agitation, the following components:

(iv) a first portion of from about 10 to about 15% by weight of a polyorganosiloxane having at least one pendant sterically hindered 2° amine functionality;

(v) a first portion of from about 0.025 to about 0.075% by weight of a base component;

(vi) a second portion of from about 6 to about 10% by weight of the polyorganosiloxane; and (vii) a second portion of from about 0.025 to about 0.075% by weight of the base component.

BRIEF DESCRIPTION OF THE SEVERAL VIEWS OF THE DRAWING

Not Applicable.

DETAILED DESCRIPTION OF THE INVENTION

Other than in the operating examples, or where otherwise indicated, all numbers expressing quantities of ingredients or reaction conditions are to be understood as being modified in all instances by the term "about".

The present invention is based on the surprising discovery that a low-viscosity, easily pumpable textile softening aid based on a polyorganosiloxane having at least one pendant sterically hindered 2° amine functionality can be formulated without having to use any sophisticated, multi-propellered mixing apparatuses.

The components used to formulate the textile softening aid of the present invention include a polyorganosiloxane having at least one pendant sterically hindered 2° amine functionality; a base component; acetic acid; an alkoxylated alcohol and water.

The polyorganosiloxane having at least one pendant sterically hindered 2° amine functionality employed in the process of the present invention is formed, in general, by grafting a highly hindered, secondary amine onto a silicone backbone. Examples of suitable polyorganosiloxanes having at least one pendant sterically hindered 2° amine functionality which may be used in the process of the present invention, and methods of making them, can be found in U.S. Pat. Nos. 5,688,889; 5,540,952; 5,277,968; 5,147,578; and 5,075,403, the entire contents of each of which are incorporated herein by reference.

A particularly preferred polyorganosiloxane for use in the process of the present invention is disclosed in U.S. Pat. No. 5,688,889, at col. 10, lines 40–49.

Examples of suitable base components which can be used in the process of the invention include, but are not limited, potassium hydroxide, sodium hydroxide, lithium hydroxide, ammonium hydroxide, diethanolamine, triethanolamine, and any other base capable of forming a soluble salt. A particularly preferred base component is potassium hydroxide.

Suitable alkoxylated alcohols which may be employed in the process of the present invention are those corresponding to formula I:

$$R—(EO)_x(PO)_y—OH \quad (I)$$

wherein R is an alkyl group having from about 10 to about 15 carbon atoms, x is a number from 1 to about 9, and y is a number from 0 to about 9. A particularly preferred alkoxylated alcohol for use in the present invention is one wherein R is a C12–14 alkyl group, x is a number from about 3 to about 6, and y is zero.

The process of the present invention involves combining the above-disclosed components, in a specific order, in order to formulate a textile softening composition having a viscosity of up to 100 cps. The process involves first forming a primary mixture by introducing, into a clean and dry vessel, with agitation, the following components: (a) from about 60 to about 80% by weight, preferably from about 65 to about 75% by weight, and most preferably from about 69 to about 71% by weight, of water, at room temperature; (b) from about 5 to about 15% by weight, preferably from about 7 to about 13% by weight, and most preferably from about 9 to about 11% by weight, of an alkoxylated alcohol, preferably tridecyl alcohol having from about 3 to about 6 moles of ethylene oxide; and (c) from about 0.15 to about 1% by weight, preferably from about 0.3 to about 0.5% by weight, and most preferably from about 0.35 to about 0.45% by weight, of acetic acid. It should be noted that agitation of the contents of the vessel is to be maintained throughout the entire process of the present invention.

To this primary mixture there are then added the following components, in the disclosed order: (d) a first portion of a polyorganosiloxane having at least one pendant sterically hindered 2° amine functionality, in an amount of from about 10 to about 15% by weight, preferably from about 11 to about 14% by weight, and most preferably from about 12 to about 13% by weight, after which a noticeable increase in viscosity of the mixture is observed; (e) a first portion of base component in an amount of from about 0.025 to about 0.075% by weight, preferably from about 0.035 to about 0.065% by weight, and most preferably from about 0.045 to about 0.055% by weight, after which a noticeable drop in viscosity is then observed; (f) a second portion of the polyorganosiloxane in an amount of from about 6 to about 10% by weight, preferably from about 7 to about 9% by weight, and most preferably from about 7.5 to about 8.5% by weight, after which a small increase in viscosity is observed; and (g) a second portion of base component in an amount of from about 0.025 to about 0.075% by weight, preferably from about 0.035 to about 0.065% by weight, and most preferably from about 0.045 to about 0.055% by weight, after which a drop in the viscosity of the mixture is realized. This mixture is then agitated/mixed for a sufficient period of time until a uniform textile softening composition is obtained. This final product will have a Brookfield viscosity of up to 100 cps, and preferably from about 60 to about 80 cps, measured at 25° C., using a #1 spindle, at 60 rpm.

Once the textile softening composition is formulated, additional textile finishing additives may be combined therewith, if desired. Examples of suitable additives include lubricants, antistats, and the like.

The textile softening composition may then be applied onto textile fibers and/or woven substrates (fabrics) by conventional techniques employed in the textile manufacturing industry. A particularly useful method of application is the impregnation technique known as "padding". After the composition has been applied onto the substrate, it is then subjected to a heat treatment which rapidly drives off the water from the substrate.

In general, the textile softening composition will be applied onto the textile substrate in an amount of from about 0.5 to about 5% by weight, based on the weight of the dry substrate being treated.

The present invention will be better understood from the examples which follow, all of which are intended for illustrative purposes only, and are not meant to unduly limit the scope of the invention in any way.

EXAMPLES

A textile softening composition, in accordance with the present invention, was formulated per the following procedure:

(1) A clean and dry vessel was provided in which the composition was formulated;

(2) water was charged into the vessel in an amount of 69.5% by weight, at a temperature of from 25 to 40° C., at which time continuous agitation was commenced;

(3) a tridecyl alcohol having 6 moles of ethylene oxide was charged into the vessel in an amount of 7.5% by weight;

(4) a tridecyl alcohol having 3 moles of ethylene oxide was charged into the vessel in an amount of 2.5% by weight;

(5) glacial acetic acid was then charged into the vessel in an amount of 0.4% by weight;

(6) a first portion of a polyorganosiloxane having a pendant sterically hindered 2° amine functionality* was then slowly charged into the vessel in an amount of 12% by weight;

(7) a first portion of potassium hydroxide was then slowly charged into the vessel in an amount of 0.05% by weight;

(8) a second portion of the polyorganosiloxane was then slowly charged into the vessel in an amount of 8% by weight;

(9) a second portion of the potassium hydroxide was then slowly charged into the vessel in an amount of 0.05% by weight; and

(10) the mixture was then mixed in the vessel until a uniform composition was obtained.

The physical properties of the above-disclosed softening composition are outlined in Table 1, below:

(*) The polyorganosiloxane employed is defined in U.S. Pat. No. 5,540,952, at col. 14, lines 27–40.

TABLE 1

| Physical Properties | |
|---|---|
| appearance, at 25° C. | clear liquid microemulsion |
| pH, 5% neutral DI water | 4.6 |
| % solids content | 30 |
| solubility, 5% | readily dispersible in water |
| viscosity, 25° C., cps, Brookfield/ #1 spindle/60 rpm | 70 |

What is claimed is:

1. A process for making a textile softening composition having a viscosity of up to about 100 cps, comprising the steps of:

(a) forming a primary mixture by combining, with agitation:

(i) from about 0.15 to about 1% by weight of acetic acid;

(ii) from about 5 to about 15% by weight of an alkoxylated alcohol; and (iii) from about 60 to about 80% by weight of water; and (b) adding to the primary mixture, with agitation, the following components sequentially:

(iv) a first portion of from about 10 to about 15% by weight of a polyorganosiloxane having at least one pendant sterically hindered 2° amine functionality;

(v) a first portion of from about 0.025 to about 0.075% by weight of a base component;

(vi) a second portion of from about 6 to about 10% by weight of the polyorganosiloxane; and (vii) a second portion of from about 0.025 to about 0.075% by weight of the base component, all weights being based on the weight of the composition.

2. The process of claim 1 wherein the acetic acid is present in the composition in an amount of from about 0.35 to about 0.45% by weight, based on the weight of the composition.

3. The process of claim 1 wherein the alkoxylated alcohol is tridecyl alcohol containing from about 3 to about 6 moles of ethylene oxide.

4. The process of claim 1 wherein the alkoxylated alcohol is present in the composition in an amount of from about 9 to about 11% by weight, based on the weight of the composition.

5. The process of claim 1 wherein the first portion of polyorganosiloxane is added to the composition in an amount of from about 12 to about 13% by weight, based on the weight of the composition.

6. The process of claim 1 wherein the second portion of polyorganosiloxane is added to the composition in an amount of from about 7.5 to about 8.5% by weight, based on the weight of the composition.

7. The process of claim 1 wherein the first portion of base component is added to the composition in an amount of from about 0.045 to about 0.055% by weight, based on the weight of the composition.

8. The process of claim 1 wherein the second portion of base component is added to the composition in an amount of from about 0.045 to about 0.055% by weight, based on the weight of the composition.

9. The process of claim 1 wherein the base component is potassium hydroxide.

10. The process of claim 1 wherein the composition has a viscosity of from about 60 to about 80 cps.

* * * * *